United States Patent [19]

Iizuka

[11] 4,201,180

[45] May 6, 1980

[54] SPLIT ENGINE OPERATION OF CLOSED LOOP CONTROLLED MULTI-CYLINDER INTERNAL COMBUSTION ENGINE WITH AIR-ADMISSION VALVE

[75] Inventor: Haruhiko Iizuka, Yokosuka, Japan

[73] Assignee: Nissan Motor Company, Limited, Yokohama, Japan

[21] Appl. No.: 947,638

[22] Filed: Oct. 2, 1978

[30] Foreign Application Priority Data

Nov. 29, 1977 [JP] Japan ..... 52/159832[U]

[51] Int. Cl.[2] ..... F02D 17/00

[52] U.S. Cl. ..... 123/198 F; 123/32 EE; 123/119 A; 60/288

[58] Field of Search ..... 123/198 F, 119 A, 119 EC, 123/32 EE; 60/288

[56] References Cited

U.S. PATENT DOCUMENTS

| | | | |
|---|---|---|---|
| 2,875,742 | 3/1939 | Dolza | 123/198 F |
| 3,756,205 | 9/1973 | Frost | 123/198 F |
| 3,765,394 | 10/1973 | Francis | 123/198 F |
| 3,800,772 | 4/1974 | Gospodar | 123/198 F |
| 4,107,921 | 8/1978 | Lizuka | 123/198 F |
| 4,114,374 | 9/1978 | Tanahashi | 123/198 F |

FOREIGN PATENT DOCUMENTS

| | | | |
|---|---|---|---|
| 2628091 | 7/1977 | Fed. Rep. of Germany | 123/198 F |

*Primary Examiner*—Ira S. Lazarus

*Attorney, Agent, or Firm*—Schwartz, Jeffery, Schwaab, Mack, Blumenthal & Koch

[57] ABSTRACT

Split engine operation of a closed loop controlled multi-cylinder internal combustion engine is effected by a charge forming device which comprises an induction system including a common chamber divided by a partition into a first sub-chamber and into a second sub-chamber and an air admission valve to permit or prevent admission of air into the second sub-chamber. The first sub-chamber has an opening communicating with the atmosphere to supply air to three cylinders and, when the air admission valve is opened, the second sub-chamber will communicate with the opening to supply air to the remaining three cylinders. The air admission valve is opened to effect 6-cylinder mode engine operation and is closed to effect 3-cylinder mode engine operation. At 3-cylinder mode engine operation, substantially all of the exhaust gases discharged from the inactive three cylinders are fed to the second sub-chamber for recirculation via these three cylinders and all of the exhaust gases discharged from the active three cylinders are permitted to flow toward an oxygen sensor for the closed loop control.

6 Claims, 6 Drawing Figures

SPLIT ENGINE OPERATION OF CLOSED LOOP CONTROLLED MULTI-CYLINDER INTERNAL COMBUSTION ENGINE WITH AIR-ADMISSION VALVE

BACKGROUND OF THE INVENTION

This invention relates to an engine control system and, in particular, to a charge forming device to effect split engine operation of a closed loop controlled multi-cylinder internal combustion engine.

Closed loop or feed back control of a multi-cylinder internal combustion engine is known in which the quantity of fuel fed to the engine is controlled in response to the output from an oxygen sensor, which detects the oxygen concentration of the exhaust gases discharged from all cylinders of the engine, in order to maintain the air fuel ratio of the mixture to be supplied to the engine at stoichiometry to cause a three-way catalytic converter, in the engine exhaust system, to operate most efficiently.

It is also known to operate a multi-cylinder internal combustion engine by suspending the supply of fuel to selected cylinders, less than the total number, to render them inactive and by increasing the load on the remaining active cylinders to operate them efficiently under high load conditions to improve the fuel economy of the engine.

This is known as split engine operation. Applying this split engine operation to a closed loop controlled internal combustion engine provided with a three-way catalytic converter will cause the air fuel ratio of the exhaust gases to deviate considerably from stoichiometry toward the lean side when the engine is shifted into split engine operation mode because at this engine operation mode the exhaust gases discharged from the active cylinders will be diluted with air discharged from the remaining inactive cylnders.

As a result, the quantity of fuel to the active cylinders will be increased excessively in accordance with the output from the oxygen sensor which represents the oxygen concentration of the exhaust gases containing oxygen from the air discharged from the inactive cylinders, thereby to deteriorate the driveability, thus worsening the fuel economy of the engine.

In order to prevent this, it is known to maintain the intake and exhaust valves for the inactive cylinders in their closed conditions to prevent air induction and air discharge by these cylinders. With this, overenrichment of the air fuel mixture charge to the active cylinders will be prevented and the pumping loss by the inactive cylinders will be reduced. The problem encountered in this known system is that since the inactive cylinders operate with their intake and exhaust valves in closed conditions, the pistons are likely to suffer from compression loss.

SUMMARY OF THE INVENTION

It is therefore an object of the present invention to provide an engine control system with a charge forming device adapted to effect split engine operation by preventing supply of fresh air to the inactive cylinders and by recirculating substantially all of the exhaust gases discharged from these inactive cylinders back into these inactive cylinders, thereby to prevent dilution of the exhaust gases discharged from the remaining active cylinders with gases discharged from the inactive cylinders and thereby to prevent the compression loss of the inactive cylinders.

DESCRIPTION OF THE PREFERRED EMBODIMENTS

Figure 1:
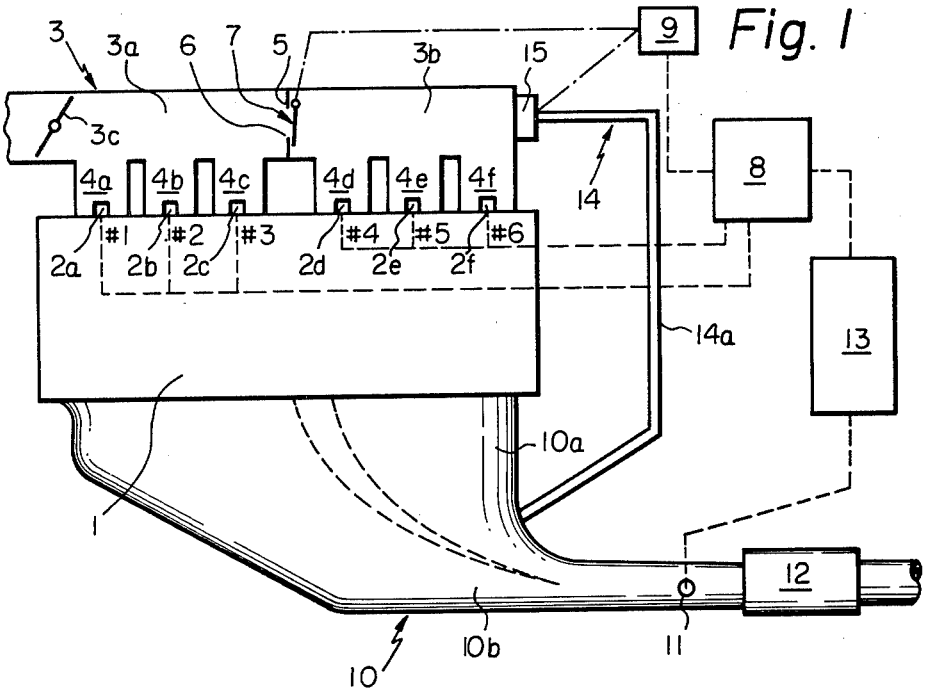
FIG. 1 is a schematic diagram of a first preferred embodiment of an engine control system according to the invention.
Figure 2:
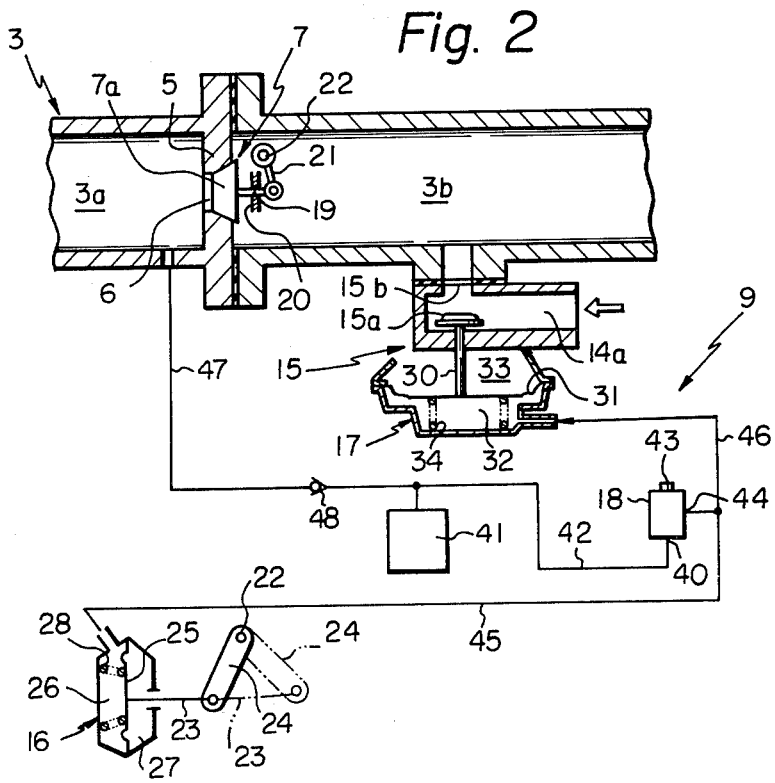
FIG. 2 is a schematic view of the air admission valve, the exhaust gas recirculation (EGR) valve and their control diagram in the system shown in FIG. 1.

Referring to FIGS. 1 and 2, the first preferred embodiment will be described. In this embodiment, a multi-cylinder internal combustion engine 1 is employed which has six cylinders divided into two groups, one group consisting of three cylinders #1 to #3 and the other group consisting of the remaining three cylinders #4 to 6. These cylinders #1 to #6 are supplied by separate fuel injectors **2*a* to 2*f***, respectively.

An induction system 3 has a common chamber divided by a partition 5 into a first sub-chamber **3*a* and a secnd sub-chamber 3*b*. The first sub-chamber 3*a* has three runner passages 4*a*, 4*b* and 4*c* extending toward the cylnders #1, #2 and #3 and communicating with an air induction passage in which a throttle valve 3*c* is rotatably mounted. The second sub-chamber 3*b* has three runner passages 4*d*, 4*e* and 4*f* extending toward the cylinders #4, #5 and #6. The partition 5 is formed with an opening 6 which establishes air flow communication between the two sub-chambers 3*a* and 3*b*. An air admission valve 7 is provided to open or close the opening 6**.

Under the control of fuel injection control unit 8, the three fuel injectors **2*a*, 2*b* and 2*c* are operated to discharge fuel to the corresponding three cylinders #1, #2 and #3 through the whole engine operating condition, but, the remaining three fuel injectors 2*d*, 2*e* and 2*f* are rendered inoperable to suspend supply of fuel to the corresponding remaining three cylinders #4, #5 and #6** during a predetermined engine operating condition.

An exhaust system 10 includes a first exhaust passage **10*b* leading from the three cylinders #1, #2 and #3 and a second exhaust passage 10*b* leading from the remaining three cylinders #4, #5 and #6. The first exhaust passage 10*a* joins the second exhaust passage 10*a***.

An oxygen sensor 11 is mounted in the exhaust system 10 at a location preferably downstream of the junction at which the first exhaust passage **10*b* joins the second exhaust passage 10*a*. A three-way catalytic converter 12 is connected to the exhaust system 10 at a location downstream of the oxygen sensor 11. Output from the oxygen sensor 11, which represents the oxygen concentration of the exhaust gases within the exhaust systen 10 at the location downstream of the junction, is fed to an air fuel ratio control unit 13 which compares the output from the oxygen sensor 11 with a target value to provide a deviation signal. The deviation signal is fed to the fuel injection control unit 8** where the quantity of fuel to be injected per each injection is determined so as to reduce the deviation signal to zero.

The fuel injection control unit 8 includes a circuit means responsive to engine load for providing a 3-cylinder mode operation command signal when the engine operates under light load. When the 3-cylinder mode operation command signal appears, supply of a fuel injection pulse signal to the three fuel injectors 2*d*, 2*e* and 2*f* will be cut off, thereby to render the cylinders #4, #5 and #6 inactive.

An exhaust gas recirculation (EGR) system 14 includes an exhaust gas recirculation (EGR) passage 14*a* leading from the second exhaust passage 10*a* to the sub-chamber 3*b* to recirculate the exhaust gases discharged from the three cylinders #4, #5 and #6 to the sub-chamber 3*b*. An exhaust gas recirculation (EGR) valve 15 is provided to control flow of exhaust gases through the exhaust gas recirculation passage 14*a*.

An actuator means 9 is provided for urging the air admission valve 7 to take a closed condition and the EGR valve 15 to take a fully open condition when the 3-cylinder mode operation command signal appears.

As best seen in FIG. 2, the actuator means 9 includes a diaphragm device 16 for the air admission valve 7, a diaphragm device 17 for the EGR valve 15, and a solenoid operable valve 18 responsive to the 3-cylinder mode operation command signal. FIG. 2 shows the closed condition of the air admission valve 7 and the fully open condition of the EGR valve 15.

The air admission valve 7 has a poppet valve member 7*a* and a valve stem 19 slidably extending through a guide 20. The valve stem 19 has one end fixed to the valve member 7*a* and an opposite end linked to one end of an arm 21 whose other end is fixedly connected to one end of a rotatable shaft 22 for rotation therewith. The rotatable shaft 22 is rotatable by a plunger 23 of the diaphragm device 16 via an arm 24. The arm 24 is fixedly mounted at one end thereof to the rotatable shaft 22 and is linked at its opposite end to the plunger 23. The plunger 23 is fixed at one end thereof to a diaphragm 25 which separates a power or vacuum chamber 26 from an atmospheric chamber 27. A spring 28 is mounted with the vacuum chamber 26 to urge the plunger 23 and the arm 24 toward the phantom line illustrated positions in which the valve member 7*a* is in an open position to permit air flow communication through the opening 6. When a vacuum is applied to the vacuum chamber 26, the diaphragm 25 is deflected toward the left, viewing in FIG. 2, against the bias of the spring 28 to pull the plunger 23 to the left, thereby to rotate the rotatable shaft 22 clockwise, viewing in FIG. 2. This clockwise rotation of the rotatable shaft 22 will urge the valve member 7*a* to take the illustrated closed position in which air flow communication through the opening 6 is prevented.

The EGR valve 15 has a valve member 15*a* cooperating with a valve port 15*b*. The valve member 15*a* is fixedly connected to one end of a plunger 30 which is fixed at its opposite end to a diaphragm 31. The diaphragm 31 separates a power or vacuum chamber 32 from an atmospheric chamber 33. A spring 34 is disposed in the vacuum chamber 32 to urge the valve member 15*a* upwardly, viewing in FIG. 2, toward the valve port 15*b*. When the atmospheric pressure is applied to the vacuum chamber 32, the spring 34 urges the valve member 15*a* toward the valve port 15*b* to take a closed position in which the valve member 15*a* closes the valve port 15*b* to prevent admission of exhaust gases into the sub-chamber 3*b*. When the vacuum is applied to the vacuum chamber 32, the diaphragm 31 is deflected downwardly against the bias of the spring 34 to move the valve member 15*a* downwardly toward the illustrated fully open position in which the admission of the exhaust gases into the sub-chamber 3*b* is permitted.

The solenoid valve 18 is a so-called "three-way" solenoid valve which has a vacuum port 40 connected to a vacuum tank 41 via a vacuum line 42, an air bleed port 43 communicating directly with the atmosphere, and a control port 44 connected to the vacuum chamber 26 via a vacuum line 45 and also connected to the vacuum chamber 32 via a vacuum line 46 branching from the vacuum line 45. The vacuum tank 41 is connected to the induction system through a vacuum line 47 via a check valve 48. With this check valve 48, the vacuum within the vacuum tank 41 will be maintained at a sufficiently high level.

Figure 3:
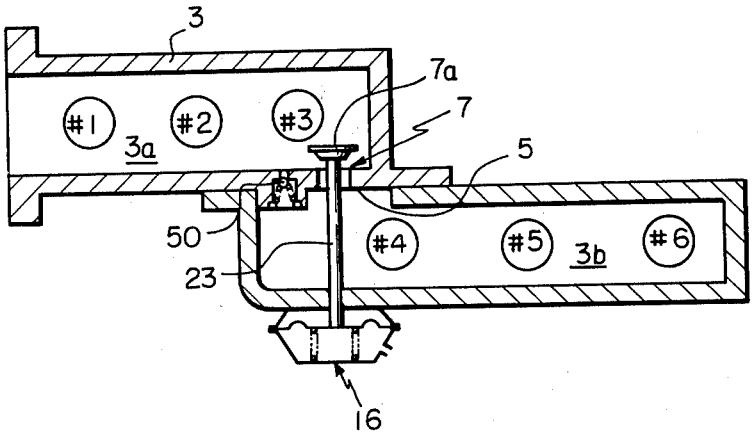
FIG. 3 is a schematic view of another example of the induction system with another example of the air admission valve.

Referring to FIG. 3, a more simple operative connection between a valve member 7*a* and a diaphragm 16 for an air admission valve 7 is shown, in which the valve member 7*a* is fixedly connected to a plunger 23 of the diaphragm device 16 which extends transversely with respect to the longitudinal direction of an induction system 3. In this example, a partition 5 is provided with a check valve 50 which is designed to be opened to permit air flow communicating therethrough between sub-chambers 3*a* and 3*b* when vacuum within the sub-chamber 3*b* is higher than that in sub-chamber 3*a*.

Figure 4:
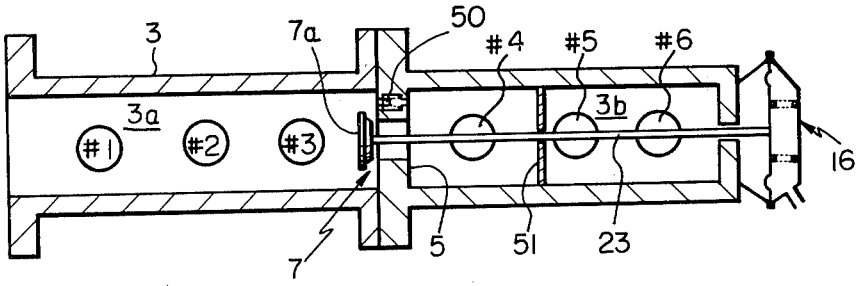
FIG. 4 is a schematic view of the induction system similar to that of FIG. 2 showing still another example of the air admission valve.

Referring to FIG. 4, this example differs from that of FIG. 3 only in that a plunger 23 having a valve member 7*a* fixedly connected thereto extends along the longitudinal direction of the sub-chamber 3*b* and is slidably guided through a guide 51.

The operation of the engine control system shown in FIGS. 1 and 2 will be described.

When the engine 1 operates under any load condition except for a light load, the fuel injection signal is supplied to all of the fuel injectors 2*a* to 2*f* to effect full cylinder or 6-cylinder operation of the engine. Under this condition, the 3-cylinder operation mode command signal does not appear. Then, the solenoid valve 18 is in a state in which air flow communication between the control port 44 and the air bleed port 43 only is permitted, while, air flow communication between the control port 44 and the vacuum port 40 is prevented, thereby to apply atmospheric pressure to the vacuum chambers 26 and 32, thus causing the air admission valve 7 to be opened and the EGR valve 15 to be closed. Since the air admission valve 7 is opened to permit air flow communication between the two sub-chambers 3*a* and 3*b*, air will be supplied to all of the cylinders #1 to #6.

When a light load condition of the engine 1 is detected, the 3-cylinder operation mode command signal appears. In response to this command signal the fuel injection control unit 8 will prevent the supply of a fuel injection signal to the three fuel injectors 2*d*, 2*e* and 2*f* to render the corresponding three cylinders #4, #5 and #6 inactive. Then, the solenoid valve 18 is shifted into a second state in which the air flow communication between the control port 44 and the air bleed port 43 is prevented, while, the air flow communication between the control port 44 and the vacuum port 40 is permitted, thereby to apply the vacuum within the vacuum tank 41 to the vacuum chambers 26 and the vacuum chamber 32, thus causing the air admission valve 7 to be closed and the EGR valve to be fully opened, as illustrated in FIG. 2. Since no fuel or fresh air is supplied to the inactive cylinders #4, #5 and #6, these inactive cylinders #4, #5 and #6 will induct exhaust gases recirculated into the sub-chamber 3*a* from the exhaust passage 10*a* during their induction strokes and will discharge the same exhaust gases into the exhaust passage 10*a* during their exhaust strokes. When vacuum within the sub-chamber 3*b* has been reduced to a predetermined level, the amount of the exhaust gas drawn in by the inactive cylinders and the amount of exhaust gas discharged from these inactive cylinders will balance. In this manner substantially all of the exhaust gases discharged from the inactive cylinders will be recirculated through the EGR passage 14, the sub-chamber 3*b*, the inactive cylinders #4, #5 and #6, and the exhaust passage 10*a* cyclically when the engine 1 operates at 3-cylinder mode.

As a result, since there occurs little pumping loss by the inactive cylinders #4, #5 and #6 and no fresh charge is discharged from them, only the exhaust gases discharged from the active cylinders #1, #2 and #3 will flow past the junction, at which the exhaust passage 10*a* joins the exhaust passage 10*b*, toward the oxygen sensor 11. Since the oxygen sensor 11 detects the oxygen concentration of the exhasut gases discharged from the active cylinders #1, #2 and #3, the three-way catalytic converter 12 will operate efficiently and excessive enrichment of the air the fuel mixture to the active cylinders #1, #2 and #3 will be prevented.

At split engine operation mode, since the active cylinders #1, #2 and #3 operate under heavy or high load, the fuel economy of the engine is good.

Since the exhaust gases are recirculated into the sub-chamber 3*b* at split engine operation mode, any change in oil level when the engine 1 is shifted between full cylinder mode and split cylinder mode is made small.

Figure 5:
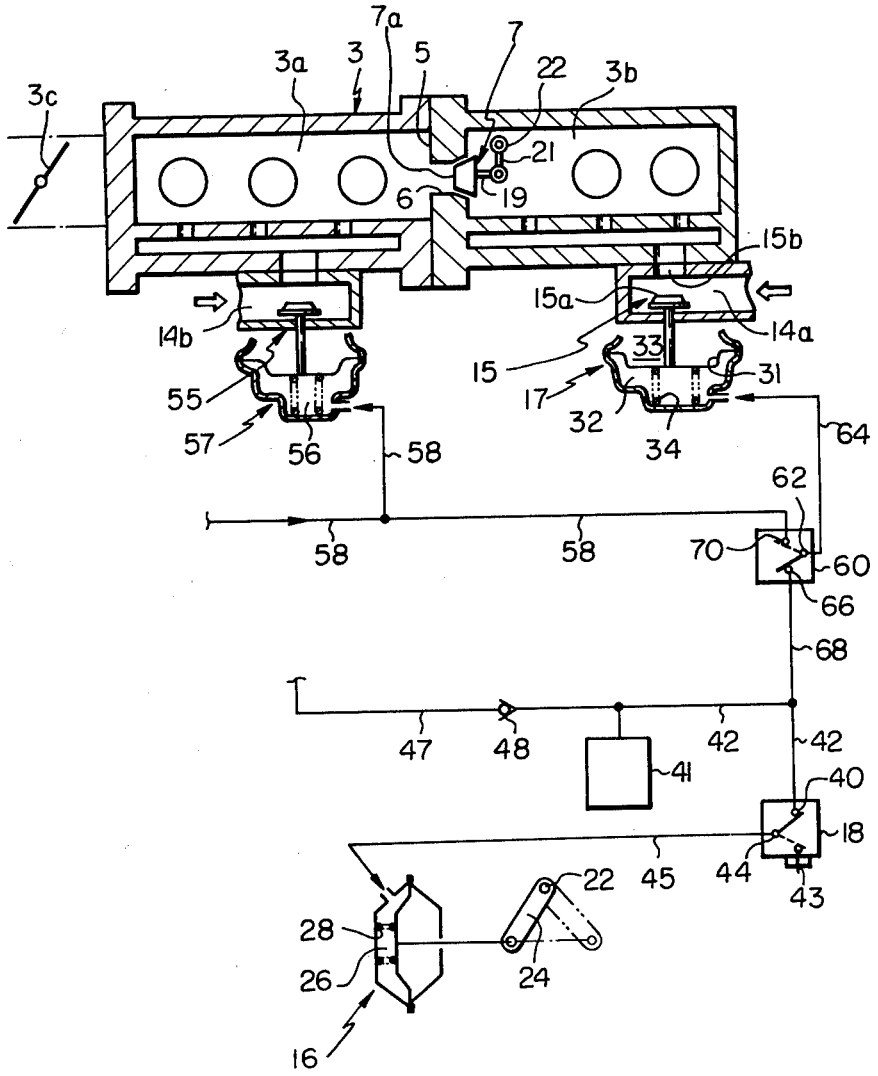
FIG. 5 is a schematic view of a second preferred embodiment of an engine control system according to the invention showing the air admission valve, two EGR valves and their control diagram in this system.

Referring to FIG. 5, this embodiment differs from the previously described embodiment in connection with FIGS. 1 and 2 in that although, in the previously described embodiment, the atmospheric pressure is applied to the vacuum chamber 32 of the diaphragm device 17 at 6-cylinder mode engine operation to close the EGR valve 15, in this embodiment a control vacuum, such as an amplified venturi vacuum, is applied to a vacuum chamber 32 of a diaphragm device 17 of an EGR valve 15 at 6-cylinder mode engine operation so that exhaust gas recirculation is effected through an EGR passage 14*a* into a sub-chamber 3*b* under the control of the EGR valve 15 at 6-cylinder mode engine operation.

Another difference is in that another independent EGR passage 14*b* leads from an exhaust system 10 to a sub-chamber 3*a* and another EGR valve 55 for controlling flow of exhaust gases through the EGR passage 14*b* is provided, as shown in FIG. 5.

To a vacuum chamber 56 of a diaphragm device 57 for the EGR valve 55, a vacuum line 58 leads from a vacuum control device(not shown) which provides the amplified venturi vacuum. Another solenoid operable three-way valve 60 is provided which has a control port 62 connected to the vacuum chamber 32 of the diaphragm device 17 via a vacuum line 64, a first vacuum port 66 connected to the vacuum tank 41 via a vacuum line 68 and the vacuum line 42, and a second vacuum port connected to the vacuum line 58.

When the engine operates at 3-cylinder mode, the solenoid operable three-way valves 18 and 60 are in the states illustrated by the solid line so that the vacuum from the vacuum tank 41 is applied to the vacuum chambers 26 and 32. Under this condition, the exhaust gas recirculation is effected through the EGR passage 14*b* under the control of the EGR valve 55, the air admission valve 7 is closed and the EGR valve 15 is fully opened to recirculate substantially all of the exhaust gases discharged from inactive cylinders #4, #5 and #6 into these cylinders.

When the engine is shifted into 6-cylinder mode from 3-cylinder mode, the solenoid operable three-way valves 18 and 60 will take the state illustrated by the dotted lines so that the atmospheric pressure is applied to the vacuum chamber 26 and the control vacuum is applied to the vacuum chamber 32. Under this cndition, therefore, the air admission valve 7 is opened and the exhaust gas recirculation is effected through the exhaust passage 14*a* under the control of the EGR valve 15.

Referring to the fuel injection control in each of the previously described embodiments, an air flow meter (not shown) is disposed upstream of the throttle valve 3*c* and the fuel injection amount or pulse width of the fuel injection command signal is controlled in accordance with the amount of intake air detected by the air flow meter, in the same manner known in the conventional fuel injection control system.

The amount of air passing through the intake manifold at an area where the throttle valve 3*c* is disposed will remain unchanged when the engine operating condition has switched from 6-cylinder mode to 3-cylinder mode as long as the throttle valve 3*c* is in a partial load position. Thus, if the fuel injection amount is unchanged upon shifting from 6-cylinder mode into 3-cylinder mode the air fuel charge within each of the disabled cylinders will become excessively lean. In order to avoid this problem the fuel injection pulse width should be increased generally to double the amount when the engine operates at the previous 6-cylinder mode.

Figure 6:
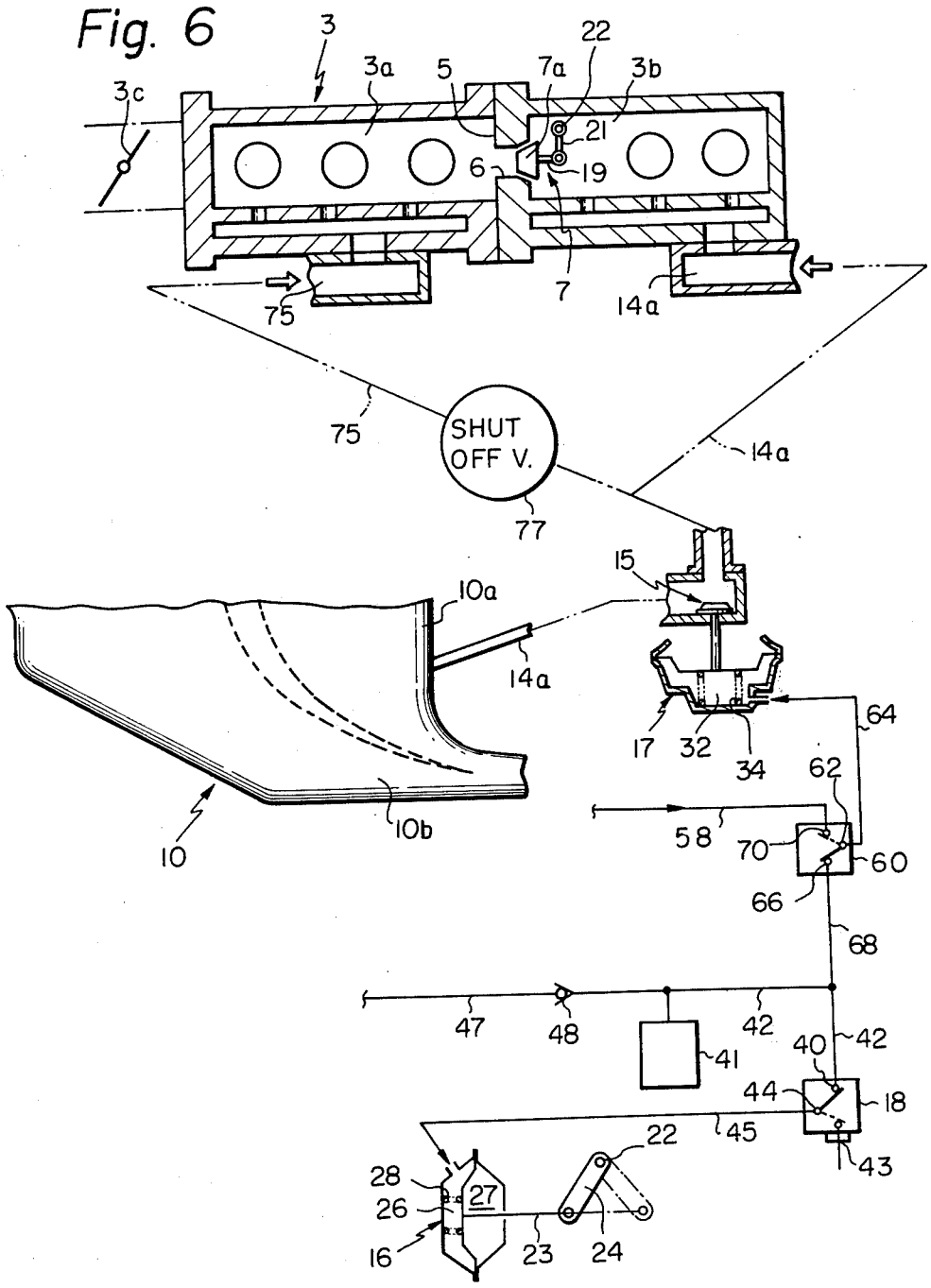
FIG. 6 is a schematic view of a third preferred embodiment in an engine control system according to the invention showing the air admission valve, the EGR valve, the shut off valve and their control diagram of this system.

Referring to FIG. 6, this embodiment differs from the FIG. 5 embodiment in that instead of two independent EGR passages 14*a* and 14*b* provided with separate EGR valves 15 and 55, a passage 75 branches from an EGR passage 14*a* at a junction disposed downstream of an EGR valve 15 and a shut off valve 77 is provided to close the passage 75.

At 6-cylinder mode engine operation, the shut off valve 77 opens the passage 75 so that the exhaust gas will be recirculated into both sub-chambers 3*a* and 3*b* under the control of the EGR valve 15.

At 3-cylinder mode engine operation, the shut off valve 77 closes the passage 75 and the EGR valve 15 is fully opened, so that substantially all of the exhaust gases discharged from the inactive cylinders will be recirculated into the sub-chamber 3*b* to be drawn in by these inactive cylinders.

What is claimed is:

1. A multi-cylinder internal combustion engine comprising:

a first cylinder group comprising certain of a plurality of cylinders;

a second cylinder group comprising the remainder of said plurality of cylinders;

a first induction passage communicating, at one end, with said first cylinder group and, at the other end, with the atmosphere and having a throttle valve therein;

a second induction passage communicating, at one end, with said second cylinder group and, at the other end, with said first induction passage downstream from said throttle valve;

a first exhaust passage communicating, at one end, with said first cylinder group and, at the other end, with the atmosphere;

a second exhaust passage communicating, at one end, with said second cylinder group and, at the other end, with said first exhaust passage;

an oxygen sensor disposed in said first exhaust passage, said sensor including means for generating an output signal representative of the oxygen content in the exhaust gases;

a three-way catalytic converter disposed in said first exhaust passage downstream from the portion of said second exhaust passage communicating with said first exhaust passage;

a first fuel injector disposed in said first induction passage for feeding fuel to said first cylinder group;

a second fuel injector disposed in said second induction passage for feeding fuel to said second cylinder group;

an air admission valve disposed at the portion of said second induction passage communicating with said first induction passage, said valve selectively establishing and blocking the communication between said first and second induction passages;

an exhaust gas recircularion (EGR) device having an EGR passage leading from said second exhaust passage to said second induction passage and including an EGR valve disposed in said EGR passage;

means for controlling said first and second injectors in response to the output signal of said oxygen sensor such that both of said first and second injectors operate when the engine is operated under a heavy load condition, and only said first injector operates when the engine is operating under a light load condition;

means for controlling said air admission valve in response to engine operation, such that said air admission valve controlling means opens said valve when the engine is operating under a heavy load condition and closes said valve when the engine is operating under a light load condition; and means for controlling said EGR device, wherein said EGR device controlling means opens said EGR valve and recirculates exhaust gas from said second exhaust passage to said second induction passage when the engine is operating under a light load condition.

2. An internal combustion engine as claimed in claim 1, wherein said means for controlling said EGR device closes said EGR valve during heavy load conditions.

3. An internal combustion engine as claimed in claim 1, further comprising:

a second exhaust gas recirculation (EGR) device having a second EGR passage leading from one of said first and second exhaust passages to said first induction passage and including a second EGR valve disposed in said second EGR passage.

4. An internal combustion engine as claimed in claim 1, further comprising:

a second EGR passage leading from said first EGR passage downstream of said EGR valve to said first induction passage; and a shut off valve disposed in said second EGR passage for blocking the flow of EGR gas therethrough in response to said light load condition.

5. An internal combustion engine as claimed in claim 1, wherein said means for controlling said air admission valve comprises a vacuum motor having a vacuum chamber fluidly communicating with said second induction passage; and a one way check valve interposted between and fluidly interconnecting said first and second induction passages, said one way check valve being adapted to open when the vacuum in said second induction passage is higher than that in said first induction passage.

6. An internal combustion engine as claimed in claim 1, wherein said means for controlling said air admission valve comprises a vacuum motor having a vacuum chamber which is fed vacuum from a source of vacuum in response to said engine operating under a light load.

* * * * *